US009657535B2

(12) United States Patent
Breit et al.

(10) Patent No.: US 9,657,535 B2
(45) Date of Patent: May 23, 2017

(54) FLEXIBLE ELECTRICAL SUBMERSIBLE PUMP AND PUMP ASSEMBLY

(71) Applicant: General Electric Company, Schenectady, NY (US)

(72) Inventors: Stephen Michael Breit, Edmond, OK (US); Jeremy Daniel Van Dam, West Coxsackie, NY (US); Vishal Gahlot, Moore, OK (US)

(73) Assignee: General Electric Company, Niskayuna, NY (US)

( * ) Notice: Subject to any disclaimer, the term of this patent is extended or adjusted under 35 U.S.C. 154(b) by 780 days.

(21) Appl. No.: 14/013,219

(22) Filed: Aug. 29, 2013

(65) Prior Publication Data

US 2015/0060043 A1 Mar. 5, 2015

(51) Int. Cl.

| | |
|---|---|
| ***E21B 43/12*** | (2006.01) |
| ***E21B 17/08*** | (2006.01) |
| ***E21B 43/14*** | (2006.01) |
| ***E21B 17/02*** | (2006.01) |
| ***E21B 17/05*** | (2006.01) |

(52) U.S. Cl.

CPC ..... *E21B 17/08* (2013.01); *E21B 17/02* (2013.01); *E21B 17/05* (2013.01); *E21B 43/12* (2013.01); *E21B 43/128* (2013.01); *E21B 43/14* (2013.01)

(58) Field of Classification Search

CPC ..... E21B 17/02; E21B 17/05; E21B 17/08; E21B 43/12; E21B 43/14; E21B 43/128

See application file for complete search history.

(56) References Cited

U.S. PATENT DOCUMENTS

| | | | | |
|---|---|---|---|---|
| 3,423,959 A | | 1/1969 | Tate et al. | |
| 4,425,965 A | | 1/1984 | Bayh et al. | |
| 5,129,452 A | * | 7/1992 | Wilson | E21B 17/1035 166/242.2 |
| 5,501,580 A | * | 3/1996 | Barrus | E21B 43/128 166/107 |
| 5,845,709 A | * | 12/1998 | Mack | E21B 43/128 166/105.5 |

(Continued)

FOREIGN PATENT DOCUMENTS

| | | |
|---|---|---|
| GB | 2475074 A | 5/2011 |
| WO | 2014100369 A1 | 6/2014 |

OTHER PUBLICATIONS

PCT Search Report and Written Opinion issued in connection with corresponding PCT Application No. PCT/US2014/050193 on Apr. 8, 2015.

*Primary Examiner* — Robert E Fuller
*Assistant Examiner* — David Carroll
(74) *Attorney, Agent, or Firm* — Pabitra K. Chakrabarti

(57) ABSTRACT

A submersible pumping assembly for a deviated wellbore is disclosed. The pump assembly including one or more electric submersible pumps disposed in a casing. The casing being disposed in a below ground deviated wellbore. The assembly including one or more electric motors disposed in the casing and configured to operate the one or more electric submersible pumps. The assembly further including one or more flexible joints. The one or more flexible joints are configured to linearly couple the one or more electric submersible pumps and the one or more electric motors and impart flexibility to the assembly in the deviated wellbore. Also provided is a submersible assembly for pumping a fluid.

18 Claims, 8 Drawing Sheets

(56) References Cited

U.S. PATENT DOCUMENTS

| | | | | |
|---|---|---|---|---|
| 6,328,111 | B1 * | 12/2001 | Bearden | E21B 23/00 166/106 |
| RE37,995 | E | 2/2003 | Barrus et al. | |
| 7,896,079 | B2 | 3/2011 | Dyer et al. | |
| 8,021,129 | B2 | 9/2011 | Traylor et al. | |
| 8,042,612 | B2 | 10/2011 | Crossley et al. | |
| 8,074,714 | B2 | 12/2011 | Reid et al. | |
| 2010/0212914 | A1 | 8/2010 | Traylor | |
| 2012/0012333 | A1 | 1/2012 | Quigley et al. | |
| 2013/0043034 | A1 | 2/2013 | Drablier et al. | |
| 2013/0098632 | A1 | 4/2013 | Wetzel et al. | |
| 2014/0169988 | A1 * | 6/2014 | Pesek | E21B 43/128 417/53 |
| 2014/0179448 | A1 * | 6/2014 | Collins | E21B 43/128 464/147 |

* cited by examiner

FLEXIBLE ELECTRICAL SUBMERSIBLE PUMP AND PUMP ASSEMBLY

BACKGROUND

The present disclosure relates to downhole electric submersible pump assemblies. More particularly, the present disclosure relates to electric submersible pump assemblies configured to provide improved bending flexibility during installation in downhole deviated wells.

Electric submersible pump assemblies are used in a wide variety of environments, including wellbore applications for pumping production fluids, such as water or petroleum. Electric submersible pump assemblies typically include, among other components, a submersible pump that provides for the pumping of high volumes of fluid, such as for use in oil wells which produce large quantities of water, or high volume water wells and a submersible motor for operating the electric submersible pump. A typical electric submersible pump utilizes numerous stages of diffusers and impellers, referred to as pump stages, for pumping fluid to the surface from the well. During operation, the impellers are configured to rotate within the diffusers.

Recovery of hydrocarbon resources has led to the development of advanced drilling and completion strategies for wells in gas and oil reserves. Many of these wells deviate from a straight path in order to enter production zones and follow geological formations that are often within a narrow band. In many cases it is desirable to install artificial lifting equipment such as the previously described electric submersible pumps to produce fluids from deviated wells. Traditional equipment is designed to be somewhat rigid and typically accommodates only a small degree of bending.

In some cases the diameter of the well is selected to be larger than that necessary to achieve maximum production rates and to allow smaller diameter and more flexible equipment to be installed within. The cost of drilling larger diameter wells and installing larger well casing represents a significant capital expense that is negatively impacted. In other cases, wells are drilled with less severe bends, or lower values of "Dogleg Severity" (DLS), to accommodate traditional electric submersible pumping equipment with only a limited degree of flexibility. This need to provide bend radii when drilling a well results in longer total lengths of wells or otherwise reduced coverage within a production zone.

In order to increase flexibility of electrical submersible pumps it is possible to design smaller and smaller diameter equipment. Such equipment will accommodate deviated wells with greater dogleg severity, but typically provide inferior performance compared to larger diameter equipment. It is known that a maximum production rate possible with reduced diameter equipment is less than a maximum achievable rate with larger diameter equipment.

Accordingly, it is desired to provide for an electric submersible pump assembly that provides for installation of equipment within wells that have a deviation from a straight path and therefore enables greater optimization of drilling strategies without requiring the use of reduced diameter equipment. Further it is desired to provide a flexible electric submersible pump assembly that allows increased production rates and greater total recovery from a reserve that is exploited using deviated wells.

BRIEF DESCRIPTION

These and other shortcomings of the prior art are addressed by the present disclosure, which provides a flexible electric submersible pump assembly.

One aspect of the present disclosure resides in a submersible pumping assembly for a deviated wellbore comprising one or more electric submersible pumps and one or more electric motors disposed in a casing, the casing disposed in a below ground deviated wellbore. The one or more electric submersible pumps including one or more stationary elements or rotating elements. The one or more electric motors configured to operate the one or more electric submersible pumps. The one or more electric motors including one or more stationary elements or rotating elements. The assembly further including one or more flexible joints configured to linearly couple one or more of the stationary elements or the rotating elements of the one or more electric submersible pumps and the one or more electric motors and impart flexibility to the submersible pumping assembly in the deviated wellbore.

Another aspect of the present disclosure resides in a submersible pumping assembly for a deviated wellbore comprising a casing disposed in a below ground deviated wellbore. One or more equipment sections are disposed in the casing and housing therein one or more electric submersible pumps. The one or more electric submersible pumps including one or more stationary elements or rotating elements. The assembly further including one or more equipment sections disposed in the casing and housing therein one or more electric motors configured to operate the one or more electric submersible pumps. The one or more electric motors including one or more stationary elements or rotating elements. The assembly still further including one or more flexible joints configured to linearly couple one or more of the stationary elements or the rotating elements of the one or more equipment sections, the flexible joints imparting flexibility to the submersible pumping assembly.

Yet another aspect of the disclosure resides a submersible assembly for pumping a fluid comprising a casing disposed in a below ground deviated wellbore and one or more electric submersible pumps disposed in the casing. The one or more electric submersible pumps including one or more stationary elements, including a housing, or rotating elements, including at least one impeller and at least one diffuser configured in cooperative engagement. The housing, the at least one impeller, and the at least one diffuser define an internal volume within the housing, said internal volume configured to receive a fluid. The assembly further including one or more electric motors disposed in the casing and configured to operate the one or more electric submersible pumps. The one or more electric motors including one or more stationary elements or rotating elements. One or more flexible joints are included in the assembly and configured to linearly couple one or more of the stationary elements or the rotating elements of the one or more electric submersible pumps and the one or more electric motors and impart flexibility to the submersible assembly in the deviated wellbore.

Various refinements of the features noted above exist in relation to the various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of the present disclosure without limitation to the claimed subject matter.

BRIEF DESCRIPTION OF THE DRAWING FIGURES

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
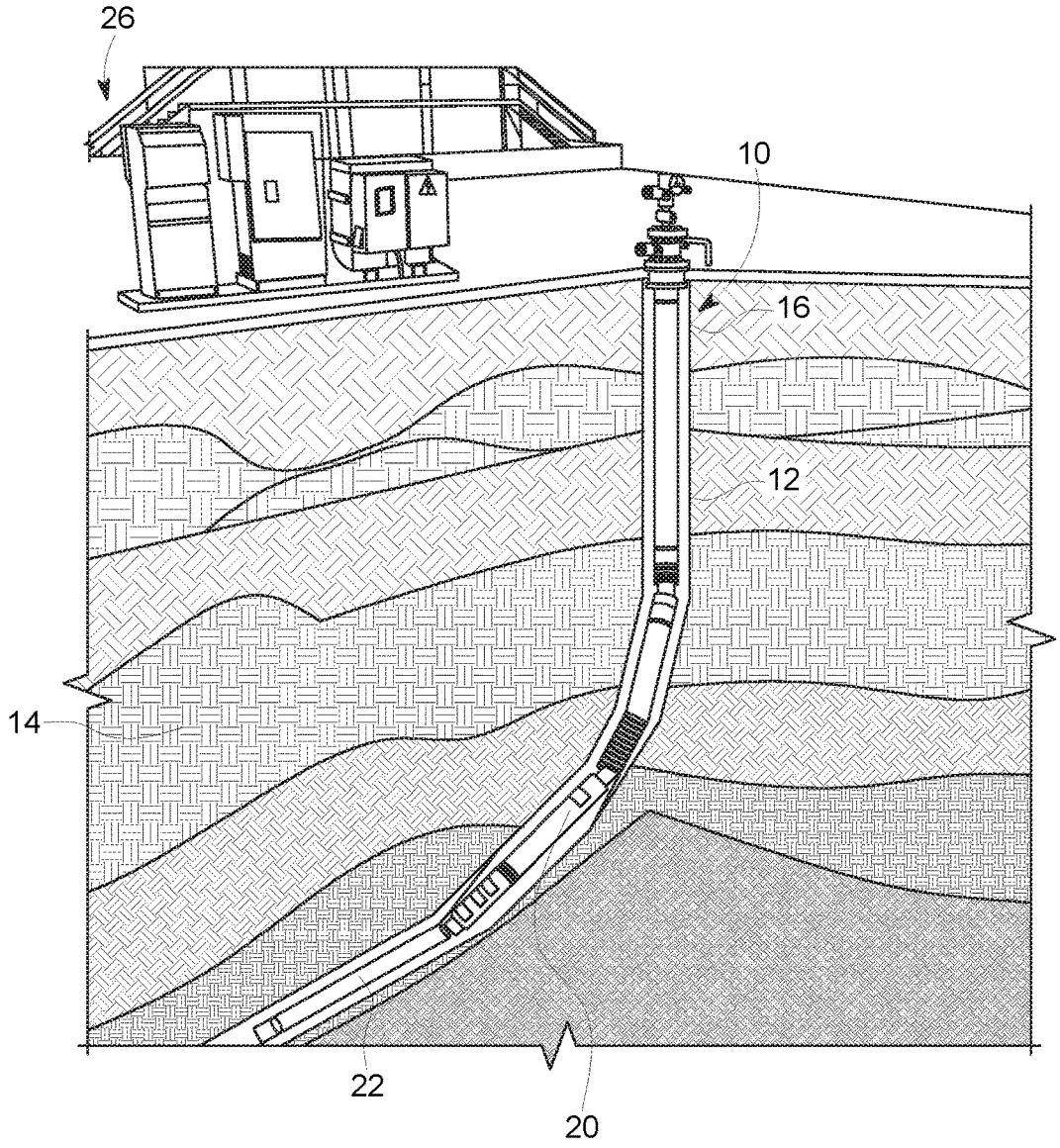
FIG. 1 is a schematic partial sectional view of an electric submersible pump assembly disposed within a deviated wellbore in accordance with one or more embodiments shown or described herein.

The disclosure will be described for the purposes of illustration only in connection with certain embodiments; however, it is to be understood that other objects and advantages of the present disclosure will be made apparent by the following description of the drawings according to the disclosure. While preferred embodiments are disclosed, they are not intended to be limiting. Rather, the general principles set forth herein are considered to be merely illustrative of the scope of the present disclosure and it is to be further understood that numerous changes may be made without straying from the scope of the present disclosure.

As described in detail below, embodiments of the present disclosure provide a flexible electric submersible pump assembly that allows for the installation of equipment within wells that have a greater deviation from a straight path and therefore enables greater optimization of drilling strategies. The flexible electric submersible pump assembly allows increased production rates and greater total recovery from a reserve that is exploited using deviated wells.

The terms "first," "second," and the like, herein do not denote any order, quantity, or importance, but rather are used to distinguish one element from another and intended for the purpose of orienting the reader as to specific components parts. Approximating language, as used herein throughout the specification and claims, may be applied to modify any quantitative representation that could permissibly vary without resulting in a change in the basic function to which it is related. The modifier "about" used in connection with a quantity is inclusive of the stated value, and has the meaning dictated by context, (e.g., includes the degree of error associated with measurement of the particular quantity). Accordingly, a value modified by a term or terms, such as "about", is not limited to the precise value specified. In some instances, the approximating language may correspond to the precision of an instrument for measuring the value.

In the following specification and the claims, the singular forms "a", "an" and "the" include plural referents unless the context clearly dictates otherwise. As used herein, the term "or" is not meant to be exclusive and refers to at least one of the referenced components being present and includes instances in which a combination of the referenced components may be present, unless the context clearly dictates otherwise. In addition, in this specification, the suffix "(s)" is usually intended to include both the singular and the plural of the term that it modifies, thereby including one or more of that term (e.g., "the impeller" may include one or more impellers, unless otherwise specified). Reference throughout the specification to "one embodiment," "another embodiment," "an embodiment," and so forth, means that a particular element (e.g., feature, structure, and/or characteristic) described in connection with the embodiment is included in at least one embodiment described herein, and may or may not be present in other embodiments. Similarly, reference to "a particular configuration" means that a particular element (e.g., feature, structure, and/or characteristic) described in connection with the configuration is included in at least one configuration described herein, and may or may not be present in other configurations. In addition, it is to be understood that the described inventive features may be combined in any suitable manner in the various embodiments and configurations.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances, an event or capacity can be expected, while in other circumstances the event or capacity cannot occur—this distinction is captured by the terms "may" and "may be".

Figure 2:
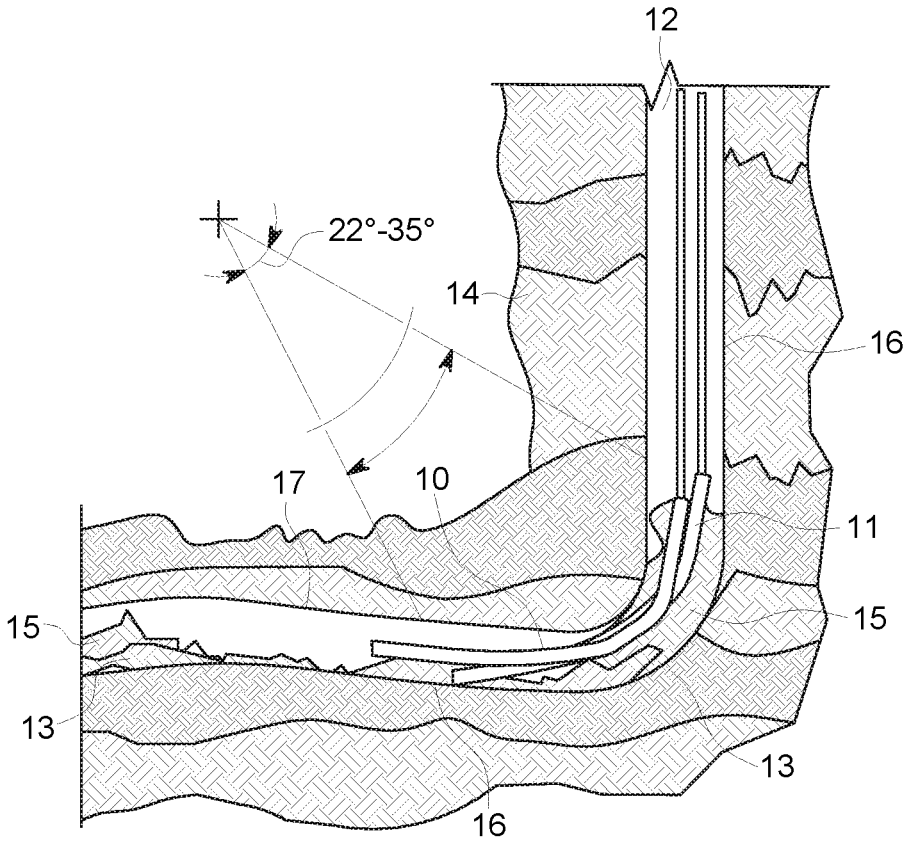
FIG. 2 is an enlarged schematic sectional view of a portion of an electric submersible pump assembly disposed within a deviated wellbore in accordance with one or more embodiments shown or described herein and illustrated in contrast to a known pump assembly.

Referring to FIG. 1, an exemplary electric submersible pump (ESP) assembly 10 is illustrated wherein the ESP assembly is disposed within a deviated, or directional, wellbore 12. In one embodiment, the deviated wellbore 12 is formed in a geological formation 14, for example, an oilfield. It is know that ESP assemblies are capable of operation at any level of inclination from 0-90 degrees. As best illustrated in FIG. 2, known ESP assemblies, indicated at 11, provide for disposing in a wellbore with a dogleg severity (DLS) of about 16-18 degrees (depending on the application). In a specific instance, 100'/DLS*(180/pi) requires a 318'-360' radius. As illustrated, the limited flexibility of these known ESP assemblies 11 equates to a limited bend radius in contrast to a bend radius of the ESP assembly 10 described herein. Through the inclusion of flexible joints in the ESP assembly 10, as disclosed and described herein, ESP assemblies may be disposed in a wellbore with a dogleg severity (DLS) reaching 30-35 degrees (depending on the application). Accordingly, a 230'-260' radius is required, providing a near 30% tighter bend radius. As illustrated in FIG. 2, residual proppants and sand 13, may lead to changing and slugging flow conditions 15 in horizontal wells. As illustrated in FIG. 2, in an embodiment, the deviated wellbore 12 includes a substantially horizontal portion 17.

Referring again to FIG. 1, the deviated wellbore 12 is lined by a string of casing 16. In an embodiment, the casing 16 is disposed within the deviated wellbore 12 and may be cemented to the surrounding geological formation 14. In an embodiment, the string of casing 16 may be further perforated to allow a fluid to be pumped (referred to herein as "production fluid") to flow into the casing 16 from the geological formation 14 and pumped to the surface of the wellbore 12.

Figure 3:
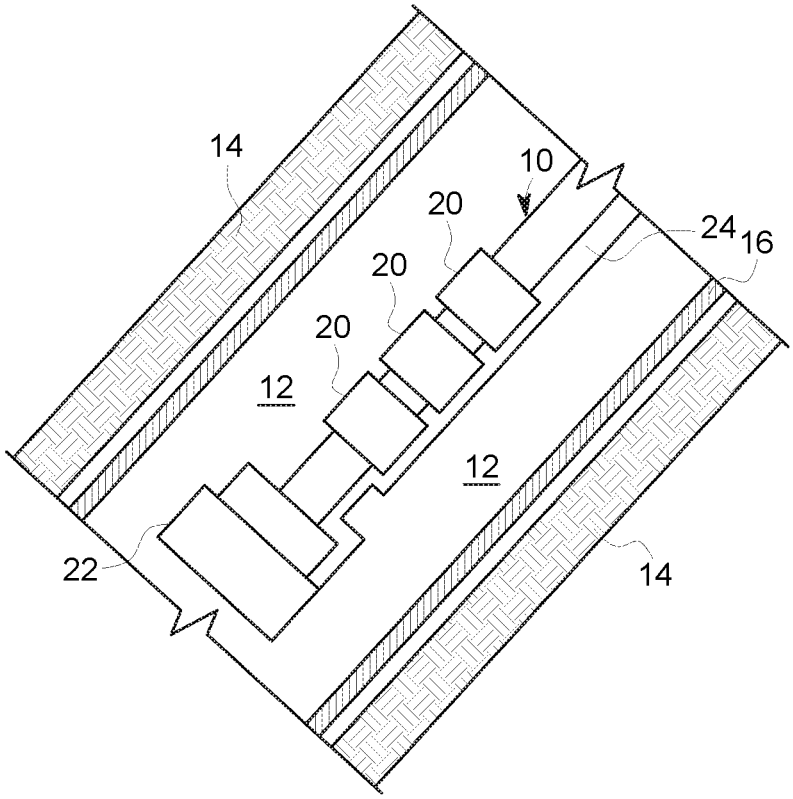
FIG. 3 is a schematic sectional view of a portion of an electric submersible pump assembly in accordance with one or more embodiments shown or described herein.

As best illustrated in FIG. 3, the ESP assembly 10 includes one or more electric submersible pumps 20, one or more electric motors 22 (of which only one is illustrated) to operate the one or more electric submersible pumps 20, and an electric cable 24 configured to power the one or more electric motors 22. In an embodiment, the one or more electric submersible pumps 20 and the one or more electric motors 22 may be configured in one of short or long segments (described presently). In an embodiment, the ESP assembly 10 may further include a gas separator (not shown), a seal (not shown), an intake (not shown), gas separator (not shown), down hole instrumentation (not shown), and additional components (not shown). As illustrated in FIG. 1, above-ground equipment 26 for operation of the ESP assembly 10, and more particularly the one or more electric submersible pumps 20 and the one or more electric motors 22 is further included.

As noted earlier, the ESP assembly 10 according to embodiments of the disclosure is disposed within the deviated wellbore 12 for continuous operation over an extended period of time. As illustrated in FIG. 1, the deviated wellbore 12 is deviated from a straight path. Accordingly, in such embodiments, the ESP assembly 10, and more specifically components of the ESP assembly 10, is configured with features that increase bending flexibility. The ESP assembly 10 thus allows installation in wells that deviate significantly from a straight path. The inclusion of this flexibility feature, as described herein, allows for bending without causing damage as the ESP assembly 10 is installed in the deviated well bore 12.

Figure 4:
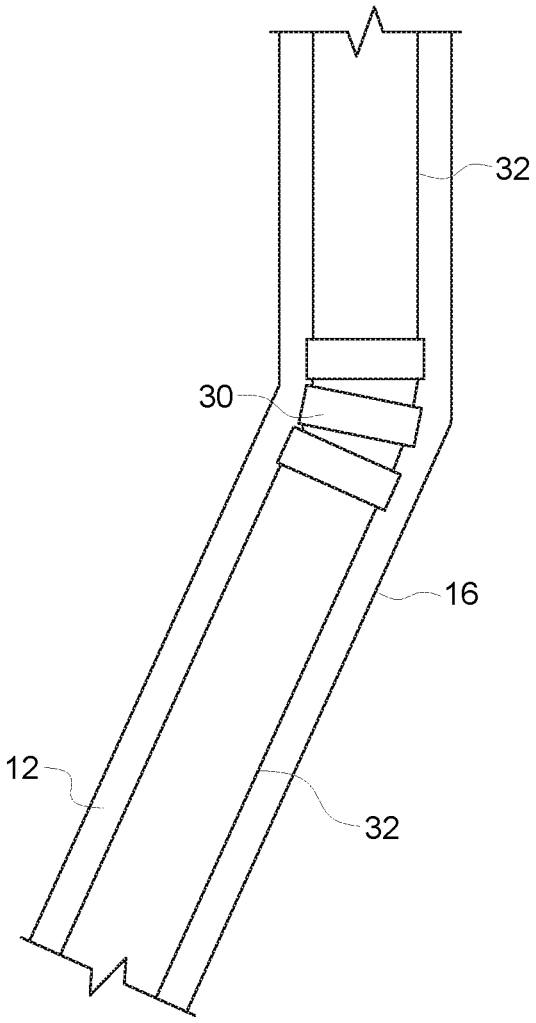
FIG. 4 is a schematic side view of a portion of an electric submersible pump assembly in accordance with one or more embodiments shown or described herein.

Referring now to FIG. 4, illustrated schematically in side view is an embodiment of a portion of the ESP assembly 10, including a flexible joint 30 as described herein. In the illustrated embodiment, the flexible joint 30 is disposed between two equipment segments 32, each having disposed therein an ESP, generally similar to ESP 20. The inclusion of the flexible joint 30 provides for deviation from a straight path during insertion of the ESP assembly 10 into the deviated wellbore 12, as illustrated. The flexible joint 30 is configured to linearly couple the equipment segments, and more particularly linearly couple the one or more electric submersible pumps 20 and the one or more electric motors 22 and impart flexibility to the ESP assembly 10 in the deviated wellbore 12.

Figure 5:
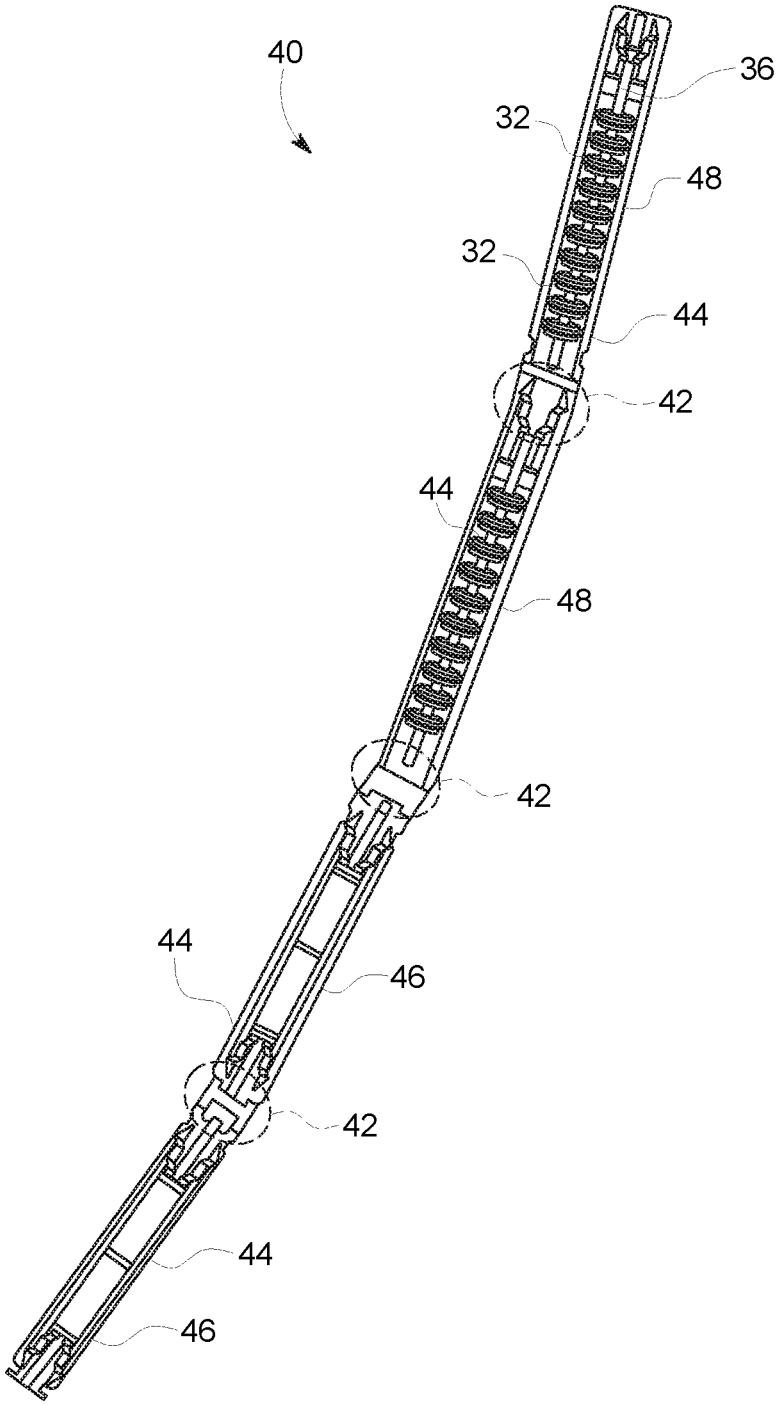
FIG. 5 is a schematic sectional view of a portion of an electric submersible pump assembly in accordance with one or more embodiments shown or described herein.

Referring now to FIG. 5, illustrated schematically is an embodiment of an ESP assembly 40, generally similar to ESP assembly 10, including one or more flexible joints, or couplings, 42, generally similar to flexible joint 30, as described herein. In the illustrated embodiment, the one or more flexible joints 42 are disposed between one or more short length equipment sections 44, such as disposed between two ESP sections 48, each having disposed therein a component of the ESP assembly 40. Each short length equipment section 44 is of limited axial length, and is connected to the next via the flexible coupling arrangement. The ESP system equipment can be connected to next piece equipment via the flexible coupling so there is a flexible coupling between each piece of the equipment in the ESP system or only as required between specific parts of the ESP system. The flexible joints 42 are configured as flex-tolerant connections, thereby allowing for the short length equipment sections 44 to flex through the deviated wellbore 12 doglegs. More specifically, in the illustrated embodiment, the four short length equipment sections 44 are configured as two electric motor equipment sections 46 and two ESP equipment sections 48. Each of the electric motor equipment sections 46 having housed therein an electric motor generally similar to electric motor 22. Each of the ESP equipment sections 48 having housed therein an ESP, generally similar to ESP 20. The one or more flexible joints 42 are configured between each of the short length equipment sections 44 to allow for bending of the overall ESP assembly 40. More specifically, as shown in the illustrated embodiment, the one or more flexible joints 42 may be configured between one ESP equipment section 48 and one electric motor equipment section 46, and/or between each of the ESP equipment sections 48 and between each of the electric motor equipment sections 46. It should be understood that while a flexible joint 42 is illustrated between each short length equipment section 44, in an embodiment, there may be a flexible joint 42 configured only between a portion of the total number of short length equipment sections 44. The inclusion of the flexible joint 42 provides for deviation from a straight path during insertion of the ESP assembly 40 into a deviated well bore, such as well bore 12 of FIG. 1.

Figure 6:
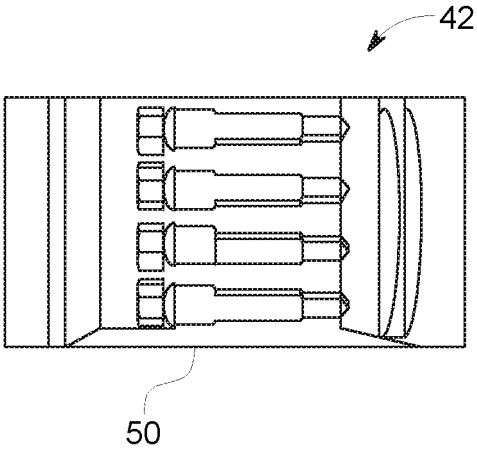
FIG. 6 is a schematic sectional view of a flexible joint for use in the electric submersible pump assembly of FIG. 5, in accordance with one or more embodiments shown or described herein.

Referring now to FIG. 6, illustrated is an enlargement of the flexible joint 42 according to an embodiment. As previously indicated, the flexible joints 42 are configured as flex-tolerant connections, thereby allowing for the short length equipment sections 44 to flex relative to one another. In the illustrated embodiment, flexible joint 42 is configured as a disc spring washer 50. As used in the art, a disc spring washer may alternatively be referred to as a coned-disc spring, a conical spring washer, a disc spring, a Belleville® spring, a cupped spring washer, or other similar term. In general, the disc spring washer 50 is configured as a type of spring that is shaped like a washer. The disc spring washer 50 has a generally frusto-conical shape which gives the washer a spring-like characteristic. The disc spring washer 50 may impart a high fatigue life into the flexible joint, provide better space utilization, low creep tendency and high load capacity.

In an alternate embodiment, the flexible joint 42 may be configured as any type of joint that will impart flexibility to the ESP assembly 40. Accordingly, the flexible joint 42 may be configured as a universal joint, a swivel joint, a knuckle joint, a coupling, or the like.

Figure 7:
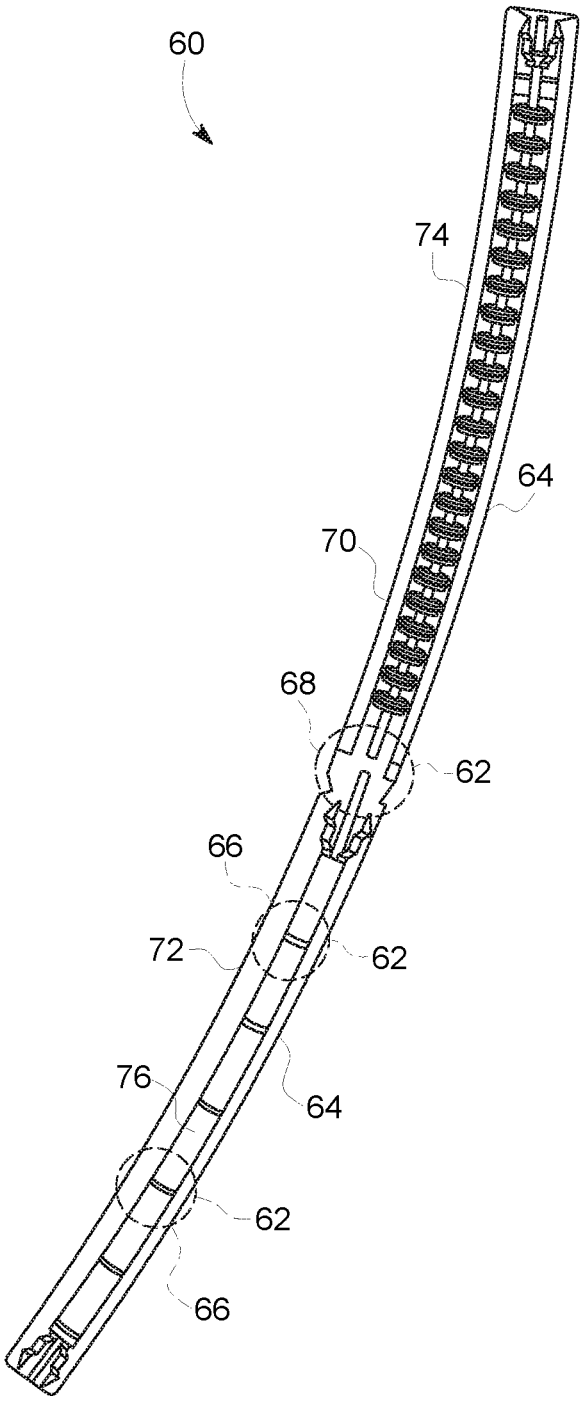
FIG. 7 is a schematic sectional view of a portion of an electric submersible pump assembly in accordance with one or more embodiments shown or described herein.
Figure 8:
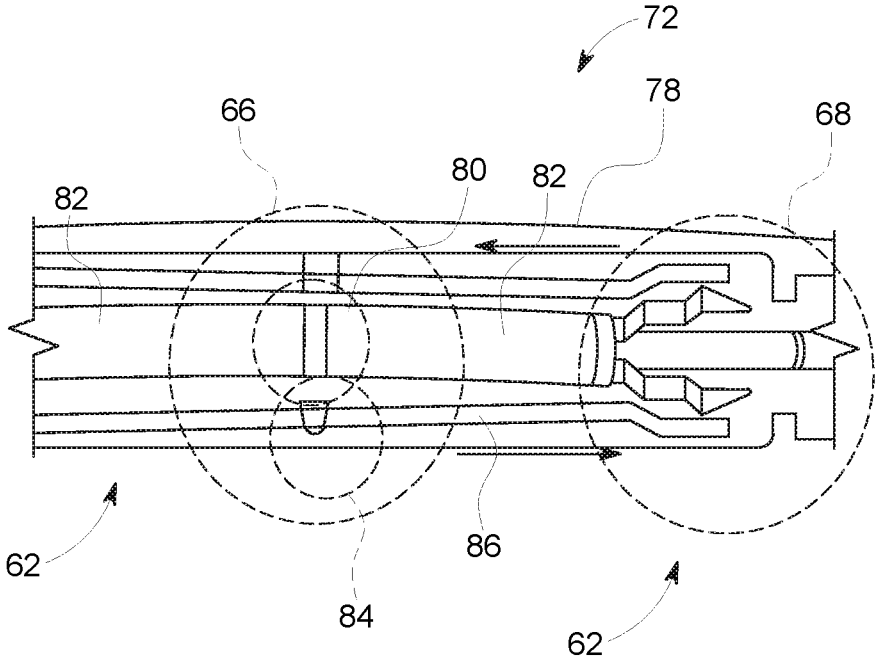
FIG. 8 is a sectional view of a portion of the electric submersible pump assembly of FIG. 7, in accordance with one or more embodiments shown or described herein.

Referring now to FIGS. 7 and 8, illustrated is another embodiment of a flexible electrical submersible pump assembly including a first set of flexible joints and a second set of flexible joints, according to the disclosure. More particularly, illustrated is an embodiment of an ESP assembly 60, generally similar to ESP assembly 10, including one or more flexible joints, or couplings 62. In the illustrated embodiment, the ESP assembly 60 includes one or more equipment sections 64, each having disposed therein a component of the ESP assembly 60, such as an ESP and cooperating electric motor, generally similar to pump 20 and electric motor 22 of FIG. 3. In contrast to the embodiment of FIG. 5, each of the one or more equipment sections 64 may be of unrestricted axial length and include the one or more flexible joints, or couplings, 62 configured within the one or more equipment sections 64, to form a first set of flexible joints, or flexing features, 66. The inclusion of the first set of flexible joints, or flexing features, 66 within the equipment section 64 provides increased bending flexibility a plurality of rotating elements, housed therein. The inclusion of the one or more flexible joints 62, and more particularly the first set of flexible joints, or flexing features, 66 within the one or more equipment sections 64 may be in addition to, or in lieu of, the inclusion of one or more flexible joints 62 disposed therebetween, each of the one or more equipment sections 64, and for purposes of clarity, referenced as a second set of flexible joints 68. In the illustrated embodiment, the one or more flexible joints 68 (of which only one is illustrated) are configured such as flexible joints 42 as described with regard to the embodiment of FIG. 5.

As previously described, the one or more flexible joints 62, disposed within and/or between the one or more equipment sections 64, are configured as flex-tolerant connections, thereby allowing for the one or more equipment sections 64, and the components housed within, to flex through the deviated wellbore 12 doglegs. More specifically, in FIG. 7, two equipment sections 64 are illustrated; a first equipment section 70 and a second equipment section 72. Housed within the first equipment section 70 is an electric submersible pump 74, generally similar to the electric submersible pump 20 of FIG. 3. Housed within the second equipment section 72 is an electric motor 76, generally similar to the electric motor 22 of FIG. 3. The one or more flexible joints 62, and more particularly the second set of flexible joints 68, are configured between the equipment sections 64 to allow for bending of the overall ESP assembly 60. More specifically, as shown in the illustrated embodiment, the second set of flexible joints 68 are configured between the first equipment section 70 and the second equipment section 72. In addition to, or in lieu of, the second set of flexible joints 68, one or more flexible joints 62, and more particularly the first set of flexible joints 66 are illustrated as configured within the second equipment section 72, and more particularly within a housing 78 of the electric motor 76.

Referring now to FIG. 8, illustrated is an enlargement of a portion of the second equipment section 72. The second equipment section 72 includes a plurality of flexible joints 62 according to an embodiment. As previously indicated, the flexible joints 62 are configured as flex-tolerant connections, thereby allowing for the equipment sections 64 to flex. In the illustrated embodiment, the one or more flexible joints 62, include the first set of flexible joints 66 (of which only one is illustrated) formed within the second equipment section 72 and the second set of flexible joints 68 (of which only one is illustrated) disposed between the equipment sections 64, and similar to the one or more flexible joints 42 of FIG. 5. In an embodiment, the first set of flexible joints 66 may be configured to include one or more flexible joints 80 between individual electric motor rotating components 82 housed therein, and/or one or more flexible joints 84 within a floating slot coil 86, or other similar component, disposed within housing 78. The one or more flexible joints 62, including the first set of flexible joints 66 and the second set of flexible joints 68, may be comprised of a disc spring washer, such as that previously described with reference to FIGS. 5-6, or configured as any type of joint that will impart flexibility to the ESP assembly 60. Accordingly, the one or more flexible joints 62 may each be configured as a knuckle joint, a universal coupling, a swivel coupling, a disc spring coupling, a bellows coupling, or any combination of flexible joints, or the like. In an embodiment, the first set of flexible joints 66 is configured to couple the stationary elements of the one or more electric motors 76 and the one or more submersible pumps 74 and the second set of flexible joints 68 is configured to couple the rotating portions of the one or more electric motors 76 and the one or more submersible pumps 74. In an embodiment, each of the first set of flexible joints 66 is configured as one of a knuckle joint, a universal coupling, a swivel coupling, a disc spring coupling, a bellows coupling, or a mechanical coupling configured to transmit torque and permit angular range of motion. In an embodiment, each of the second set of flexible joints 68 is configured as one of a knuckle joint, a universal coupling, a swivel coupling, a disc spring coupling, a bellows coupling, or a mechanical coupling configured to permit angular range of motion.

It should be understood that while the one or more flexible joints 62 are illustrated between each of the equipment sections 64 and within equipment sections 64, in an embodiment, any combination of one or more flexible joint 62 may be utilized in the ESP assembly 60, including between only a portion of the total number of equipment sections 46, within only an equipment section 64 housing the electric motor 76 components, within only an equipment section 64 housing the electric submersible pump 74 components, or any combination thereof. The inclusion of the one or more flexible joints 62 provide for deviation from a straight path during insertion of the ESP assembly 60 into a deviated well bore, such as well bore 12 of FIG. 1. The inclusion of the one or more flexible joints 62, and more particularly the first set of flexible joints 66 within the equipment sections 64, allows for larger and more power dense equipment to flex in a manner similar to smaller units. In an embodiment, the equipment sections 64 may be configured to "unlock" for installation and "lock" after placement within the deviated well bore 12.

In an embodiment, the present disclosure provides an electric submersible pump assembly capable of accommodating deviated wells with increased dogleg severity, while maintaining performance as large diameter equipment. With reference to FIGS. 3, 5 and 7, each of the one or more ESP assemblies 10, 40, 60, and more particularly each of the one or more electric submersible pumps 20, 48, 74, according to an embodiment, is configured as a multi-stage unit with the number of stages being determined by the operating requirements. Each stage consists of a driven impeller and a diffuser which directs flow to the next stage of the pump. In an embodiment, each of the electrical submersible pumps 20, 48, 74 is configured as a centrifugal pump comprising one or more pump stages. Each pump stage is comprised of at least one impeller and at least one diffuser stacked on a common shaft 36 extending at least the length of the pump section. The one or more pump stages, and more particularly the at least one impeller and at least one diffuser are disposed within a housing. The shaft 36 extends concentrically through the housing and is rotated by the one or more electric motors 22, 46, 76 thus driving the one or more electric submersible pumps 20, 48, 74.

In one embodiment, the ESP assembly 10, 40, 60 is configured to be installed in a wellbore 12. In one embodiment, the ESP assembly 10, 40, 60 is configured to be installed in a geological formation 14, such as an oilfield. In some embodiments, the ESP assembly 10, 40, 60 may be capable of pumping production fluids from a wellbore 12 or an oilfield. The production fluids may include hydrocarbons (oil) and water, for example.

In some embodiments, the ESP assembly 10, 40, 60 is installed in a geological formation 14, such as an oilfield, by drilling a hole or a wellbore 12 in a geological formation 14, for example an oilfield. The wellbore 12 maybe vertical, and may be drilled in various directions, for example, upward or horizontal. In one embodiment, the wellbore 12 is cased with a metal tubular structure referred to as the casing 16. In some embodiments, cementing between the casing 16 and the wellbore 12 may also be provided. Once the casing 16 is provided inside the wellbore 12, the casing 16 may be perforated to connect the geological formation 14 outside of the casing 16 to the inside of the casing 16. In some embodiments, an artificial lift device such as the ESP assembly 10, 40, 60 of the present disclosure may be provided to drive downhole well fluids to the surface. The ESP assembly 10, 40, 60 according to some disclosed embodiments is used in oil production to provide an artificial lift to the oil to be pumped.

An ESP assembly 10, 40, 60 may include surface components, for example, an oil platform (not shown) and sub-surface components (found in the wellbore). In one embodiment, the ESP assembly 10, 40, 60 further includes surface components 26 such as motor controller surface cables and transformers. In one embodiment, the sub-surface components may include pumps, motor, seals, or cables.

In one embodiment, an ESP assembly 10, 40, 60 includes sub-surface components such as the one or more electric submersible pumps 20, 48, 74 and the one or more electric motors 22, 46, 76 configured to operate the pumps 20, 48, 74. In one embodiment, each of the one or more electric motors 22, 46, 76 is one of a submersible squirrel cage, induction electric motor, a permanent magnet motor, or the like. The motor size may be designed to lift the desired volume of production fluids. In one embodiment, each of the one or more electric submersible pumps 20, 48, 74 is a multi-stage unit with the number of stages being determined by the operating requirements. In one embodiment, each stage of the one or more electric submersible pumps 20, 48, 74 includes a driven impeller and a diffuser which directs flow to the next stage of the electric submersible pump 20, 48, 74.

In one embodiment, each of the one or more electric motors 22, 46, 76 is further coupled to an electrical power cable 24. In one embodiment, the electrical power cable 24 is coupled to the electric motor 22, 46, 76 by an electrical connector. In some embodiments, the electrical power cable 24 provides the power needed to power the electric motor 22, 46, 76 and may have different configurations and sizes depending on the application. In some embodiments, the electrical power cable 24 is designed to withstand the high-temperature wellbore environment.

Further, as noted earlier, in one embodiment, each of the one or more electric submersible pumps 20, 48, 74 includes a housing, with the impeller and the diffuser, disposed within the housing. The housing, the impeller and the diffuser define an internal volume within the housing, said internal volume containing a fluid.

Accordingly, disclosed is a novel electric submersible pump assembly configured to provide for installation of equipment within wells that have a greater deviation from a straight path and therefore enables greater optimization of drilling strategies without requiring the use of reduced diameter equipment. Further disclosed is a flexible electric submersible pump assembly that allows increased production rates and greater total recovery from a reserve that is exploited using deviated wells.

This written description uses examples to disclose the disclosure, including the best mode, and also to enable any person skilled in the art to practice the disclosure, including making and using any devices or assemblies and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A submersible pumping assembly for a deviated wellbore comprising:

one or more electric submersible pumps disposed in a casing, the casing disposed in a below ground deviated wellbore, the one or more electric submersible pumps including one or more stationary elements or rotating elements;

one or more electric motors disposed in the casing and configured to operate the one or more electric submersible pumps, the one or more electric motors including one or more stationary elements or rotating elements; and one or more flexible joints configured to linearly couple one or more of the stationary elements or the rotating elements of the one or more electric submersible pumps and the one or more electric motors and impart flexibility to the submersible pumping assembly in the deviated wellbore, wherein the one or more flexible joints provide flexibility of the submersible pumping assembly for deployment in a deviated wellbore having a dogleg severity (DLS) in a range of 22-35 degrees.

2. The submersible pumping assembly as claimed in claim 1, wherein each of the one or more flexible joints is configured as one of a knuckle joint, a universal coupling, a swivel coupling, a disc spring coupling or a bellows coupling.

3. The submersible pumping assembly as claimed in claim 1, wherein the one or more flexible joints include a first set of flexible joints configured to couple the rotating elements of the one or more electric motors and the one or more submersible pumps and a second set of flexible joints configured to couple the stationary portions of the one or more electric motors and the one or more submersible pumps.

4. The submersible pumping assembly as claimed in claim 3, wherein each of the first set of flexible joints is configured as one of a knuckle joint, a universal coupling, a swivel coupling, a disc spring coupling, a bellows coupling or a mechanical coupling configured to transmit torque and permit angular range of motion.

5. The submersible pumping assembly as claimed in claim 3, wherein each of the second set of flexible joints is configured as a knuckle joint, a universal coupling, a swivel coupling, a disc spring coupling, a bellows coupling or a mechanical coupling configured to permit angular range of motion.

6. The submersible pumping assembly as claimed in claim 1, wherein each of the one or more electric submersible pumps is disposed within an electric submersible pump equipment section and each of the one or more electric motors is disposed within an electric motor equipment section.

7. The submersible pumping assembly as claimed in claim 6, wherein the one or more flexible joints linearly couple the electric submersible pump equipment section and the electric motor equipment section to one another.

8. The submersible pumping assembly as claimed in claim 1, wherein the one or more flexible joints provide flexibility of the submersible pumping assembly for deployment in a deviated wellbore having a dogleg severity (DLS) in a range of 30-35 degrees.

9. The submersible pumping assembly as claimed in claim 1, wherein the one or more flexible joints provide flexibility of the submersible pumping assembly for deployment in a deviated wellbore having a substantially horizontal portion.

10. A submersible pumping assembly for a deviated wellbore comprising:

a casing disposed in a below ground deviated wellbore having a dogleg severity (DLS) in a range of 22-35 degrees;

one or more electric submersible pump equipment sections disposed in the casing and housing therein one or more electric submersible pumps, the one or more electric submersible pumps including one or more stationary elements or rotating elements;

one or more electric motor equipment sections disposed in the casing and housing therein one or more electric motors configured to operate the one or more electric submersible pumps, the one or more electric motors including one or more stationary elements or rotating elements; and one or more flexible joints configured to linearly couple one or more of the stationary elements or the rotating elements of the one or more electric submersible pump equipment sections and the one or more electric motor equipment sections, the flexible joints imparting flexibility to the submersible pumping assembly.

11. The submersible pumping assembly as claimed in claim 10, wherein each of the one or more flexible joints is configured as one of a knuckle joint, a universal coupling, a swivel coupling, a disc spring coupling or a bellows coupling.

12. The submersible pumping assembly as claimed in claim 10, wherein the one or more flexible joints include a first set of flexible joints configured to couple the stationary elements of the one or more electric motors and the one or more submersible pumps and a second set of flexible joints configured to couple the rotating portions of the one or more electric motors and the one or more submersible pumps.

13. The submersible pumping assembly as claimed in claim 12, wherein each of the first set of flexible joints is configured as one of a knuckle joint, a universal coupling, a swivel coupling, a disc spring coupling, a bellows coupling, or a mechanical coupling configured to permit angular range of motion.

14. The submersible pumping assembly as claimed in claim 12, wherein each of the second set of flexible joints is configured as a knuckle joint, a universal coupling, a swivel coupling, a disc spring coupling, a bellows coupling or a mechanical coupling configured to transmit torque and permit angular range of motion.

15. The submersible pumping assembly as claimed in claim 10, wherein the one or more flexible joints provide flexibility of the submersible pumping assembly for deployment in a deviated wellbore having a substantially horizontal portion.

16. A submersible assembly for pumping a fluid comprising:

a casing disposed in a below ground deviated wellbore having a dogleg severity (DLS) in a range of 22-35 degrees;

one or more electric submersible pumps disposed in the casing, the one or more electric submersible pumps including one or more stationary elements, including a housing or rotating elements, including at least one impeller and at least one diffuser configured in cooperative engagement, wherein the housing, the at least one impeller, and the at least one diffuser define an internal volume within the housing, said internal volume configured to receive a fluid;

one or more electric motors disposed in the casing and configured to operate the one or more electric submersible pumps, the one or more electric motors including one or more stationary elements or rotating elements; and one or more flexible joints configured to linearly couple one or more of the stationary elements or the rotating elements of the one or more electric submersible pumps and the one or more electric motors and impart flexibility to the submersible assembly in the deviated wellbore.

17. The submersible assembly for pumping a fluid as claimed in claim 16, wherein the one or more flexible joints include a first set of flexible joints configured to couple the stationary elements of the one or more electric motors and the one or more submersible pumps and a second set of flexible joints configured to couple the rotating portions of the one or more electric motors and the one or more submersible pumps.

18. The submersible assembly for pumping a fluid as claimed in claim 17, wherein each of the first set of flexible joints is configured as one of a knuckle joint, a universal coupling, a swivel coupling, a disc spring coupling, a bellows coupling, or a mechanical coupling configured to permit angular range of motion and each of the second set of flexible joints is configured as a knuckle joint, a universal coupling, a swivel coupling, a disc spring coupling, a bellows coupling or a mechanical coupling configured to transmit torque and permit angular range of motion.

* * * * *